United States Patent [19]

Halilovic et al.

[11] 4,300,843

[45] Nov. 17, 1981

[54] STREAMING VIBRATOR WITH AN UNINTERRUPTED ROLLING AREA AND AN UNLOADED BLADE

[76] Inventors: Esref Halilović, D. Tucovica 141; Branko Radisic, Lole Ribara 2, both of Belgrade 11000, Yugoslavia

[21] Appl. No.: 152,839

[22] Filed: May 23, 1980

Related U.S. Application Data

[63] Continuation of Ser. No. 969,498, Dec. 14, 1978, abandoned.

[30] Foreign Application Priority Data

Dec. 15, 1977 [YU] Yugoslavia ..... 2976/77

[51] Int. Cl.[3] ..... B01F 11/00

[52] U.S. Cl. ..... 366/125; 366/600

[58] Field of Search ..... 366/101, 116, 124–126, 366/600; 415/54, 503; 308/163, 165; 418/178

[56] References Cited

U.S. PATENT DOCUMENTS

| | | | |
|---|---|---|---|
| 2,956,788 | 10/1960 | Bondeson | 366/125 |
| 3,112,098 | 11/1963 | Anderson | 366/125 |
| 3,162,426 | 12/1964 | Fontaine | 366/125 |
| 3,672,639 | 6/1972 | Wadensten | 366/125 |
| 3,790,137 | 2/1974 | Wadensten | 366/125 |

FOREIGN PATENT DOCUMENTS

| | | |
|---|---|---|
| 1291927 | 8/1964 | Fed. Rep. of Germany . |
| 1309884 | 3/1973 | United Kingdom . |
| 1409109 | 10/1975 | United Kingdom . |

*Primary Examiner*—Philip R. Coe
*Assistant Examiner*—Timothy F. Simone
*Attorney, Agent, or Firm*—Fleit & Jacobson

[57] ABSTRACT

A streaming vibrator with an uninterrupted rolling area and an unloaded blade. The vibrator has a housing with a cylindrical cavity defined therein. End plates laterally limit the cavity and support a central pipe having a periphery coaxial with a rolling area defined by the wall of the cylindrical cavity. A bore of the pipe is connectable to a source of pressurized fluid, and the pipe has an opening positioned between the end plates to provide communication between the bore and the cylindrical cavity. A freely rotatable scutching member formed as a hollow cylinder is positioned in the space between the central pipe and the rolling area. A blade extends through the opening in the pipe into contact with an interior wall of the scutching member to divide the cavity into two components. A plurality of channels are formed in the blade and oriented away from outlet openings formed in the end plates. One end of the blade contacts the interior wall of the scutching member so that the blade is moved into and out of the central pipe when the scutching member is rotated by pressurized fluid.

4 Claims, 2 Drawing Figures

STREAMING VIBRATOR WITH AN UNINTERRUPTED ROLLING AREA AND AN UNLOADED BLADE

This is a continuation of application Ser. No. 969,498 filed Dec. 14, 1978, abandoned.

FIELD OF THE INVENTION

The streaming vibrator with an uninterrupted rolling area and an unloaded blade represents a new constructional embodiment of a streaming vibrator, presenting significant technical advantages in comparison with the known vibrators.

BACKGROUND OF THE INVENTION

As to the known vibrators of this type, the rolling area is usually provided with functional openings for inlet and outlet of fluid, with a channel for the blade etc. Said openings and channel cause a series of technical, technological and functional problems. These problems are: high contact pressures of material at the edges of the openings and channel; greater requirements regarding the quality of the material; a need for thermic treatment and precise finishing; reduction of the functional efficiency of the vibrator on the grounds of a relatively low endurance limit of the contact pair in spite of the fact that materials of high quality have been used and that the materials have been treated thermically and mechanically in an optimum way. The obvious consequences of the above disadvantages are relatively high manufacturing costs of such vibrators. A further disadvantage of known embodiments is their low efficiency and the noise that is produced by the rolling of the scutching member along the channel and openings of the rolling area.

The existing vibrators of this type, i.e. provided with a blade, show a high inner resistance and, consequently, a lower efficiency due to the sliding of the unloaded blade along the scutching member of the vibrator.

The above-mentioned disadvantages of known vibrators are removed by the streaming vibrator with an uninterrupted rolling area and an unloaded blade.

BRIEF DESCRIPTION OF THE DRAWINGS

The vibrator according to this invention is shown in the attached drawing. Therein.

DESCRIPTION OF THE PREFERRED EMBODIMENT

Figure 1:
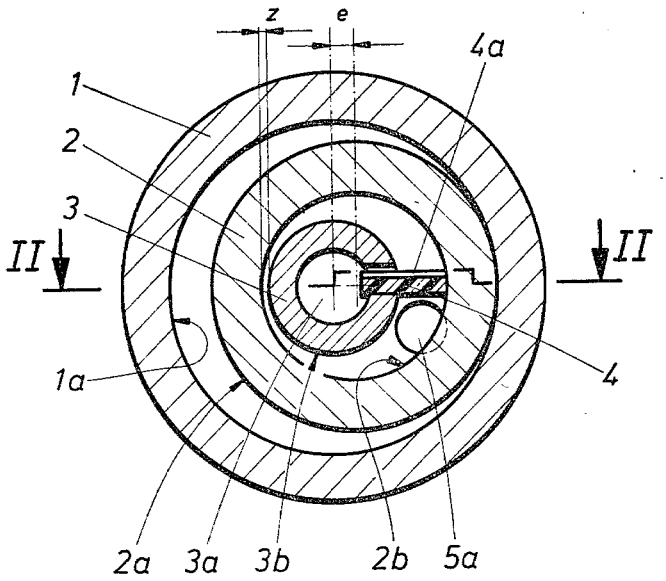
FIG. 1 is cross-sectional view of the vibrator.
Figure 2:
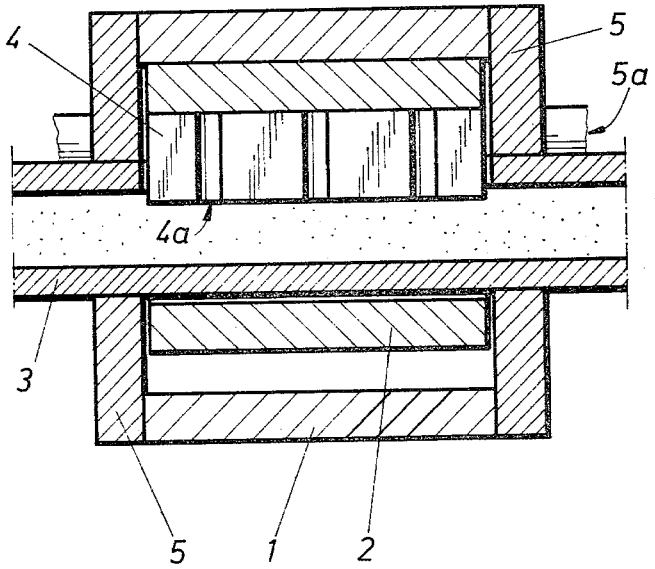
FIG. 2 is a longitudinal sectional view taken on the line II—II of FIG. 1, turned for 90° so that the axis of the vibrator becomes horizontal.

The proposed vibrator consists of a housing 1 which by means of end plates 5 encloses a cylindrical cavity defined by a rolling area 1*a* of the housing and by said end plates 5. Through the end plates 5 there is inserted a central pipe 3 coaxially with the rolling area 1*a* of the housing. Between the end plates 5, the central pipe 3 is provided with a reactangular opening through which a blade 4 of a regular prismatic shape is inserted into the central pipe 3 with a corresponding clearance. Into the space between the end plates 5, the rolling area 1*a* of the housing and the central pipe 3, a scutching member 2 shaped like a regular hollow cylinder is inserted. The length of the scutching member 2 is shorter than the distance between end plates 5 for the value of said clearance. The rolling area 1*a* of the housing is shaped like an uninterrupted cylindrical surface and is considerably bigger than the rolling area 2*a* of the scutching member, which is also shaped like an uninterrupted cylindrical surface. The difference between the radii of the above-mentioned two rolling areas represents an eccentricity e, corresponding to the functional displacement of geometrical axes of the housing 1 and the scutching member 2.

In an active position, the scutching member 2 with its rolling area 2*a* is supported by the rolling area 1*a* of the housing, whereas from inside the scutching member 2 forms with the central pipe 3*a* clearance z between the friction area 2*b* of the scutching member and the periphery 3*b* of the central pipe.

The blade 4 of the vibrator divides the space inside the scutching member 2 into two sections, i.e. a section connected with a bore 3*a* of the central pipe, and a section connected with outlet openings 5*a* foreseen in the end plates 5. At the side of the blade 4, which is oriented to the former section, there are foreseen some wind channels 4*a* in the blade.

The moving elements of the vibrator are the scutching member 2 and the blade 4.

The scutching member 2 moves epicyclically, i.e. it rotates round its proper axis as well as around the axis of the housing 1 at a distance which equals the eccentricity e. By its movement, the scutching member 2 induces cyclic sine oscillations (rotary altering of the direction of the centrifugal force).

The blade 4 exerts a radially directed reciprocating movement with respect to the housing 1.

The proposed vibrator operates in the following manner: A compressed fluid, e.g. air, is fed through the bore 3*a* of the central pipe. At starting, the fluid pressure pushes the blade 4 radially outwards and the blade 4 pushes the scutching member 2, which becomes supported by the housing 1 (this situation is represented in FIG. 1). Hereafter, the vibrator operates normally, i.e. the compressed fluid flows through the wind channels 4*a* of the blade and loads the space inside the scutching member 2, and thereafter the exploited fluid leaves through the openings 5*a*.

Inside the scutching member 2, an unequal pressure is formed. In the zone between the wind channels 4*a* of the blade and the clearance z, the fluid pressure is higher and it approximately corresponds to the pressure at the inlet, whereas in the zone between the clearance z and the outlet openings 5*a*, the fluid pressure is lower and corresponds to the pressure at the outlet. The mentioned difference of pressures causes the scutching member 2 with its rolling area 2*a* to be in contact with the rolling area 1*a* of the housing and that the rolling as such is performed without any sliding.

The friction area 2*b* of the scutching element is in continuous contact with the blade 4. The fluid causes the blade 4 to be supported by the friction area 2*b* of the scutching member and scutching member 2 with its movement returns the blade 4 into the corresponding opening in the central pipe 3.

There are two objects of the wind channels 4*a* of the blade: the conducting of the fluid and the release of the blade in the friction zone. Namely, the fluid streaming out of the bore 3*a* of the central pipe causes the blade 4 to be in contact with the friction area 2*b* of the scutching member and the channels 4*a* of the blade enable the fluid to come also into the zone between the blade 4 and the friction area 2*b* of the scutching member and to release this contact. Hence, the contacting pressure is a little higher than the releasing pressure and the blade 4 is always in a good contact with the friction area 2b of the scutching member, but it is also released of an excessive pressure, which results in a higher efficiency of the vibrator as such.

The radial clearance z between the friction area 2b of the scutching member and the periphery 3b of the central pipe has its proper dynamic features and advantages. When the frequency of rotation of the scutching member 2 around the axis of the housing 1 increases, the clearance becomes smaller because in this situation the elastic deformations of the scutching member 2 in the zone of contact with the housing 1 as well as elliptical elastic deformations of the scutching member 2 as such increase. In case of uncontrolled increase of the frequency of rotation of the scutching member 2, these elastic deformations can be increased to such an extent that the clearance z is eliminated, thus preventing the frequency to increase above an allowable limit.

Through the clearance z there continuously flows the fluid to the outlet openings 5a. In the clearance and hereafter, the fluid becomes accelerated and forms a reactive dynamical force, which assists in the rotation of the scutching member 2.

From the above description of the construction and its functioning according to the present invention, there are evident its advantages with respect to the existing analogous embodiments. Its rolling areas are big and uninterrupted, i.e. without any recesses or channels. This causes lower resistances at the rolling, lower contact pressures of materials, lower noise, longer duration of the elements and wide possibilities for manufacturing strong and high frequency vibrators.

The efficiency of the proposed vibrators increases by disclosed unloading of their blades. The constructional elements forming the radial clearance can be further used as controlling elements for limiting frequencies of the vibrators.

Considering all above advantages, the manufacturing of proposed vibrators is simple and relatively inexpensive, thus this vibrator can be widely exploited technically and economically.

What is claimed is:

1. Streaming vibrator with an uninterrupted rolling area and an unloaded blade, comprising a housing (1) with a cylindrical cavity, end plates (5) laterally limiting the cavity, the cavity defining an uninterrupted cylindrical rolling area (1a), a central pipe (3) for introducing a compressed fluid into said cavity and having a periphery (3b) coaxial with and spaced from the rolling area of the housing (1), an unloaded blade (4) extending through an opening in the pipe into the cavity, and a free scutching member (2) formed as a hollow cylinder positioned in the space between the central pipe (3) and the rolling area (1a) of the housing, the scutching member having an outer surface defining a second rolling area (2a) supported by the rolling area (1a) of the housing and an inner surface defining a friction area (2b) facing the periphery (3b) of the central pipe, a radial clearance (z) being formed between the periphery (3b) of the central pipe and the friction area (2b) of the scutching member when the second rolling area (2a) is supported by rolling area (1a), said unloaded blade (4) having a sufficient radial length to extend into contact with the friction area (2b) in all positions of the scutching member (2), and at least one of said channels (4a) extending radially from an inner surface to an outer surface of said blade so that fluid flows from said pipe, through said at least one channel, into a region between said blade and said scutching member to thereby oppose fluid forces acting on the end of said blade positioned in said pipe to thereby unload said pipe.

2. Streaming vibrator according to claim 1, further comprising an outlet opening (5a) connected to said end plates (5), and wherein the opening in the pipe (3) has a rectangular shape and is positioned close to the outlet opening, the blade (4) having a regular prismatic shape and a plurality of channels (4a) formed therein and oriented away from the outlet opening, the blade being freely inserted in the opening in the pipe.

3. A streaming vibrator comprising:

a housing (1) having a cylindrical cavity defined therein;

end plates (5) laterally limiting the cavity, the cavity having a wall defining an uninterrupted rolling area;

a central pipe (3) supported by the end plates and having a periphery (3b) spaced from and coaxial with the rolling area, the pipe having a bore (3a) connectable to a source of pressurized fluid, the pipe having an opening of rectangular shape positioned between the end plates;

a freely rotatable scutching member (2) formed as a hollow cylinder positioned in the space between the central pipe and the rolling area, the scutching member having an outer surface defining a second rolling area (2a) and an inner surface defining a friction area (2b) facing the periphery (3b) of the central pipe, a radial clearance (z) being formed between the periphery and the friction area when the second rolling area rests on the rolling area of the housing;

outlet openings (5a) extending through the end plates; and an unloaded blade (4) of regular prismatic shape freely inserted in and extending from the opening of the pipe and having a plurality of channels (4a) formed therein and oriented away from the outlet openings, an outer end of the blade being adapted to contact the friction area so that, when the pressurized fluid rotates the scutching member, the blade is reciprocated towards and away from the axis of the pipe, said channels being formed in such manner that pressurized fluid is introduced into the space between said friction area and the outer blade end to thereby unload the blade, said channels (4a) extending radially along the entire length of said blade (4) thereby permitting compressed fluid to flow from said pipe (3) into an area between an outer edge of said blade and said friction area (2b), the compressed fluid in the area exerting a force on the outer edge of said blade opposing the force exerted on the edge of said blade in said pipe to thereby unload said blade.

4. A streaming vibrator according to claim 3 wherein the scutching member is made of a deformable material so that the radial clearance (z) decreases as the speed of rotation of the scutching member increases.

* * * * *